US005769529A

United States Patent [19]

Weinstock et al.

[11] Patent Number: 5,769,529

[45] **Date of Patent: *Jun. 23, 1998**

[54] LIGHT FIXTURE

[75] Inventors: Stephen P. Weinstock, St. Louis, Mo.; Randy L. Jordan, Bethalto, Ill.

[73] Assignee: International Lighting Manufacturing Company, St. Louis, Mo.

[ * ] Notice: The term of this patent shall not extend beyond the expiration date of Pat. No. 5,426,572.

[21] Appl. No.: 802,891

[22] Filed: Feb. 18, 1997

Related U.S. Application Data

[63] Continuation of Ser. No. 442,528, May 16, 1995, abandoned, which is a continuation of Ser. No. 159,828, Dec. 1, 1993, Pat. No. 5,426,572.

[51] Int. Cl.[6] ..... F21V 23/00; F21V 29/00

[52] U.S. Cl. ..... 362/133; 362/294; 362/394

[58] Field of Search ..... 362/125, 126, 362/133, 145, 147, 226, 294, 364, 365, 373, 394

[56] References Cited

U.S. PATENT DOCUMENTS

| | | | |
|---|---|---|---|
| D. 270,481 | 9/1983 | Whitright | D26/24 |
| D. 278,937 | 5/1985 | Peeler et al. | D26/24 |
| D. 299,549 | 1/1989 | Macaluso | D26/29 |
| D. 307,806 | 5/1990 | Byar et al. | D26/37 |
| D. 312,136 | 11/1990 | Miletich et al. | D26/24 |
| D. 313,863 | 1/1991 | Macaluso | D26/29 |
| 1,239,672 | 9/1917 | Dahl | 362/235 |
| 1,648,167 | 11/1927 | Donley | 362/374 |
| 1,793,818 | 2/1931 | Morton | 362/147 |
| 2,482,430 | 9/1949 | Noel | 362/250 |
| 2,516,660 | 7/1950 | Versan | 362/364 |

(List continued on next page.)

FOREIGN PATENT DOCUMENTS

| | | | |
|---|---|---|---|
| 3136222 | 3/1983 | Germany | 362/294 |
| 7704232 | 10/1978 | Netherlands | 362/147 |

OTHER PUBLICATIONS

CSL Lighting Mfg., Mitelite TM Information Sheet 1 page, date unknown, but admitted prior art, Valencia, California.
Axis Lighting, Information Sheet, 1 page, date unknown, but admitted prior art, Brooklyn, New York.
Information Sheet on "Minilites Collection", manufacturer and date unknown, but admitted prior art.
Harry Gitlin Lighting Ad, received Oct. 28, 1981, Ceiling Lighting Fixture, #21015.
Interiors, Apr. 1988, p. 173, Roxter "Mity Lite" halogen lamp.
Alkco, Task Lighting, undated, 2 pg. (admitted prior art).
Lucifer, Lucifer Lighting Company, Puklight, 1991.

*Primary Examiner*—Y. My Quach
*Attorney, Agent, or Firm*—Senniger, Powers, Leavitt & Roedel

[57] ABSTRACT

A light fixture capable of being mounted on a downwardly-facing surface for illuminating a working surface therebelow. The fixture includes a thin-profile backing plate and a thin-profile cover. The cover releasably attaches to the backing plate to define an enclosed interior space. At least one opening is provided in a bottom wall of the cover, and at least one lamp assembly is contained substantially entirely in the enclosed interior space adjacent the opening in the bottom wall of the cover. The assembly includes a halogen lamp for emitting light in a generally downward direction onto the working surface when the cover is attached to the backing plate. A switch on the fixture varies the intensity of light emitted. The switch includes an actuator accessible from the exterior of the cover, and circuitry in the enclosed interior space for electrically connecting the actuator and lamp to a power source. The backing plate is capable of being mounted on the downwardly-facing surface without the cover attached thereto, the cover thereafter being releasably attachable to the backing plate to enclose the circuitry within the interior space. The backing plate and cover have sufficiently thin profiles that when the backing plate and cover containing the lamp assembly are assembled and mounted on the downwardly-facing surface, the overall height of the fixture is less than 1½ inches.

7 Claims, 3 Drawing Sheets

U.S. PATENT DOCUMENTS

| | | | |
|---|---|---|---|
| 2,790,894 | 4/1957 | Zingone | 362/429 |
| 3,803,396 | 4/1974 | Damico | 240/2 R |
| 4,251,855 | 2/1981 | Radek | 362/151 |
| 4,454,569 | 6/1984 | Maguire | 362/127 |
| 4,460,947 | 7/1984 | Kelly | 362/374 |
| 4,507,716 | 3/1985 | Benedict, Jr. | 362/295 |
| 4,748,545 | 5/1988 | Schmitt | 362/219 |
| 4,748,548 | 5/1988 | Barton | 362/249 |
| 4,764,851 | 8/1988 | Hartmann | 362/74 |
| 4,862,334 | 8/1989 | Ivey et al. | 362/374 |
| 4,872,099 | 10/1989 | Kelley et al. | 362/295 |
| 4,941,071 | 7/1990 | Knauf | 362/133 |
| 5,031,083 | 7/1991 | Claesson | 362/249 |
| 5,050,047 | 9/1991 | Viner et al. | 362/32 |
| 5,113,329 | 5/1992 | Lin | 362/238 |
| 5,205,637 | 4/1993 | Caspari | 362/109 |

109
37
25
35
121
21
119
31
101
93
35
33
105
27
107
99
111
103
33
103
109
125
23
87
99
43
49
53
123
95
85
71
67
89
69
71
47
63
91
61
41
75
71
97
55
57
57
69
55
11
65
71
59
67

LIGHT FIXTURE

CROSS-REFERENCE TO RELATED APPLICATIONS

This application is a continuation of application Ser. No. 08/442,528, filed May 16, 1995, now abandoned, which is a continuation of application Ser. No. 08/159,828, filed Dec. 1, 1993, now U.S. Pat. No. 5,426,572.

BRIEF SUMMARY OF THE INVENTION

This invention relates generally to light fixtures and more particularly to an under-cabinet light fixture adapted to be mounted on a downwardly-facing surface of a cabinet for illuminating a working surface below the cabinet, such as a countertop.

Generally, electrical components of a light fixture (e.g., lamp assembly, circuitry, transformer, etc.) are attached to the back plate of a housing. The back plate is mounted at a desired location and the necessary electrical connections are made between a power source and the electrical components. Next, a cover of the housing having a lens is fastened to the back plate by suitable fasteners, such as screw fasteners. In under-cabinet applications, mounting the back plate on the downwardly-facing surface of the cabinet and attaching the cover thereto may be difficult since the back plate is typically heavy because of its housed components and, in some instances, there is little space between the underside of the cabinet and a countertop below the cabinet. Also, attaching the cover to the back plate by means of screw fasteners is often inconvenient.

Another disadvantage associated with many prior art light fixtures for use in under-cabinet applications is that the lamp assembly typically has an incandescent light which provides rather weak, unfocused light directed to the countertop. Moreover, some of these incandescent lights have larger profiles and thus require the space between the back plate and the cover to be relatively deep. This is undesirable, since it is preferable that under-cabinet lights be as thin as possible so that they are not unduly obtrusive and do not take up unnecessary space below the cabinet.

Accordingly, among the several objects of the present invention is the provision of an improved under-cabinet light fixture which is easy to mount on a downwardly-facing surface of a cabinet; the provision of such a light fixture having a backing plate which is substantially free of electrical components so that it may be readily mounted on the downwardly-facing surface of the cabinet, and a cover which carries a lamp assembly and its associated circuitry and which is releasably attachable to the backing plate after it has been mounted on the cabinet; the provision of such a light fixture in which the cover carrying the electrical components is releasably attachable to the backing plate without the need for fasteners; the provision of such a light fixture capable of directing relatively focused and intense light onto a working surface; the provision of such a light fixture having a relatively thin profile so that it is unobtrusive when mounted underneath the cabinet; the provision of such a light fixture which dissipates heat efficiently while avoiding overheating of the backplate and the surface on which it is mounted; the provision of such a light fixture having lamps which are easily accessible by removing the cover by hand without the need of tools; the provision of such a light fixture which is easy to assemble; and the provision of such a light fixture which is simple in design and construction, and easy to install.

Generally, a light fixture of the present invention is capable of being mounted on a downwardly-facing surface for illuminating another surface therebelow. The light fixture comprises a backing plate for installation flat on the downwardly-facing surface, and a cover releasably attached to the backing plate in a closed position in which the backing plate and cover combine to form a substantially enclosed interior space. At least one lamp opening is provided in the cover. At least one lamp assembly is mounted adjacent the lamp opening in the cover. The lamp assembly comprises a lamp housing mounted in the aforesaid interior space. The housing of the lamp assembly has an open bottom generally in registry with the lamp opening in the cover. The housing is spaced from the backing plate to minimize the transfer of heat from the lamp assembly to the backing plate. The lamp assembly further comprises a halogen lamp for emitting light in a generally downward direction onto the aforesaid another surface when the cover is attached to the backing plate in its closed position. A diffuser closes the open bottom of the housing. An actuator is mounted on the fixture and is accessible from outside the cover for energizing the halogen lamp. A dimmer control in the interior space is electrically connected to the actuator for varying the intensity of light emitted by the halogen lamp. The actuator on the fixture turns the halogen lamp on and off and also varies the intensity of the light emitted by the halogen lamp. The backing plate and cover have sufficiently thin profiles that when the backing plate and cover are mounted on the aforesaid downwardly-facing surface with the cover in its closed position, the overall height of the fixture is less than about 1½ inches.

In another aspect of this invention, the light fixture has a touch sensor actuator for operating the dimmer control.

In still another aspect, the fixture comprises a lamp assembly mounted on the cover of the fixture. The lamp assembly includes a lamp housing comprising an annular body having a generally flat top wall and a circular side wall extending down from the top wall. A halogen lamp and reflector are housed by the lamp housing within the annular body. The annular body is secured at the lower end of its circular side wall to the bottom wall of the cover in surrounding relation with a lamp opening in the bottom wall. The annular body has a flange extending radially outwardly at the lower end of the circular side wall thereof. This flange engages the bottom wall of the cover around the lamp opening and is secured to the bottom wall. The circular side wall of the lamp housing has a height substantially less than the height of the upwardly extending peripheral wall structure of the cover so that the flat top wall of the annular body of the lamp housing is spaced from backing plate when the cover is in its closed position to minimize the transfer of heat from the lamp assembly to the backing plate. A thin substantially flat diffuser is provided for diffusing light emitted downward by the halogen lamp. The diffuser is mounted closely adjacent the bottom wall of the cover so as to contribute to the thin profile of the fixture.

In still another aspect of the invention, an undercabinet light fixture of this invention comprises an elongate, narrow, thin-profile housing comprising an elongate, narrow, thin-profile backing plate and an elongate, narrow, thin-profile cover releasably attached to the backing plate to define an elongate, narrow, thin-profile enclosed interior space. At least one opening is provided in a bottom wall of the cover. Means is provided for mounting the backing plate flat on said downwardly-facing surface. At least one lamp assembly, including a halogen lamp is contained substantially entirely within said interior space adjacent the opening in the bottom wall of the cover. The halogen lamp is operable for emitting light in a generally downward direction onto said working surface. A lamp housing is provided for mounting the halogen lamp on the housing. A transformer is provided for said halogen lamp of said at least one lamp assembly, the transformer being contained substantially entirely within said interior space. Switch means is provided on the housing for selectively energizing the halogen lamp. The switch means comprises an actuator accessible from outside the cover and circuitry in said interior space for electrically connecting the actuator and halogen lamp to a power source. The backing plate and cover have sufficiently thin profiles that when the backing plate mounted on the downwardly-facing surface and the cover containing the one lamp assembly and transformer are assembled, the overall height of the fixture is less than 1½ inches.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
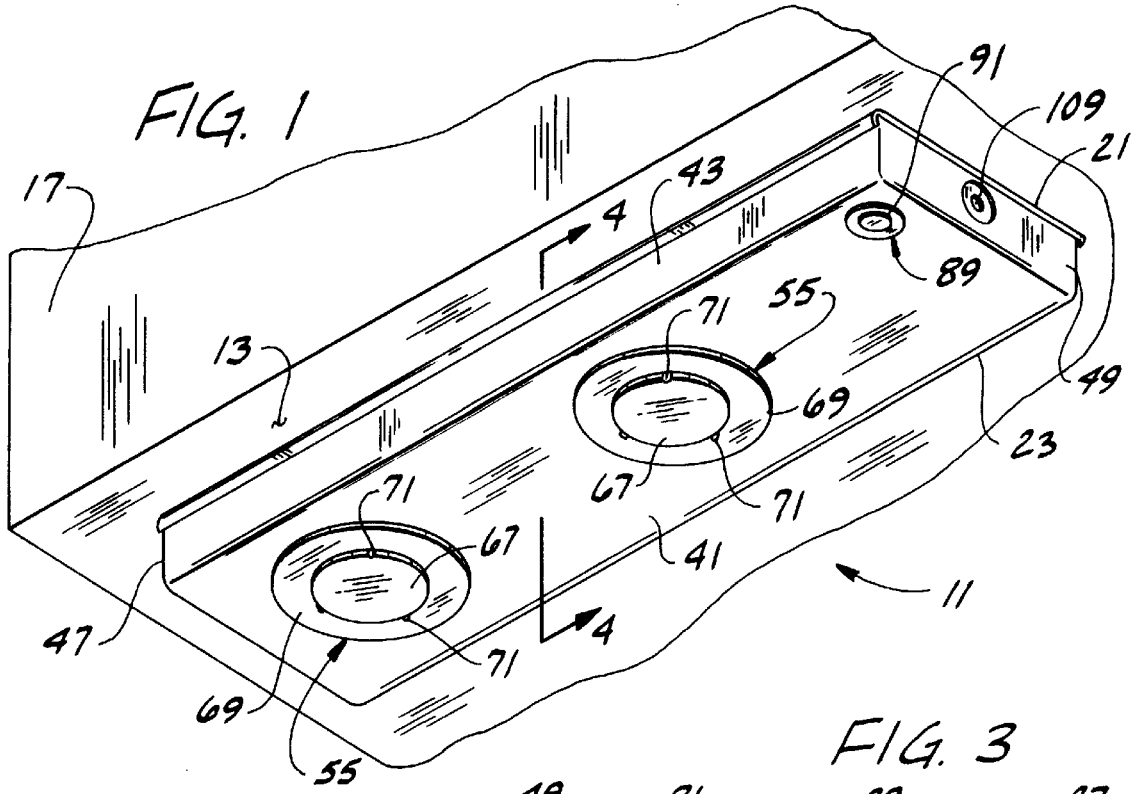
FIG. 1 is a bottom perspective of a light fixture of the present invention.

Referring now to the drawings, a light fixture of this invention is generally indicated at 11. As illustrated in FIG. 1, the light fixture 11 is especially suited for mounting on a downwardly-facing surface, such as the downwardly-facing surface 13 of a cabinet 17 hung on a wall (not shown), for illuminating a working surface below the cabinet. However, it should be understood that the light fixture 11 of the present invention may be mounted on other surfaces as well, such as vertical or angled walls. As more fully discussed below, the light fixture 11 is constructed so that it is easy to assemble and install.

Figure 2:
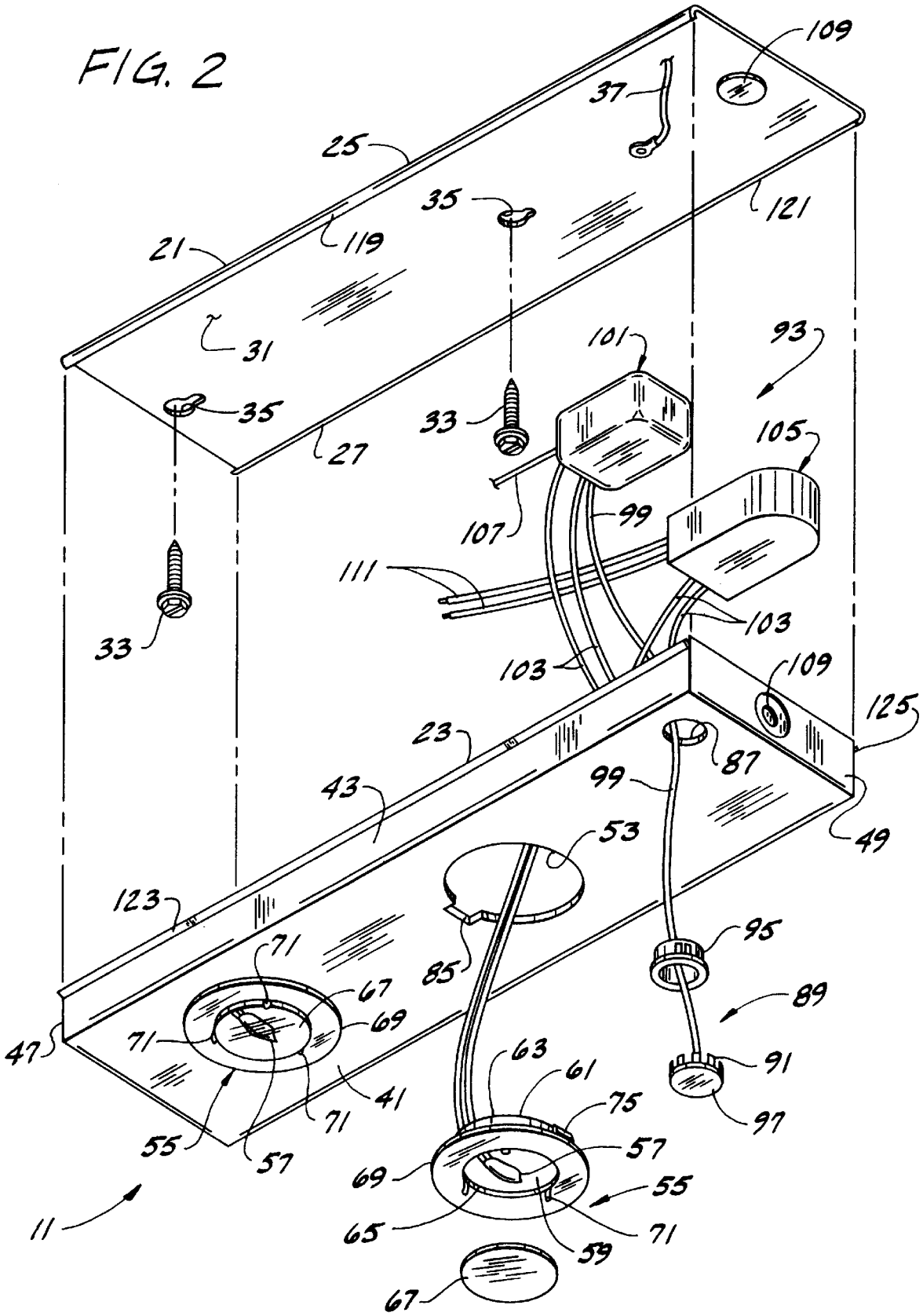
FIG. 2 is a exploded bottom perspective of the light fixture shown in FIG. 1.

As shown in FIG. 2, the light fixture 11 comprises a thin profile rectangular backing plate 21 and a similarly dimensioned thin profile rectangular cover 23, both being made from sheet metal or plastic. The narrow elongate backing plate 21 has two long sides designated 25 and 27, and, when disposed in a horizontal plane, an upper surface 29 and lower surface 31. The backing plate 21 is mounted with its upper surface 29 flat against the downwardly-facing surface 13 of the cabinet 17 by screw fasteners 33 extending through spaced-apart openings 35 in the backing plate. As shown, the backing plate 21 has a ground wire 37 for grounding the light fixture 11 when it is electrically connected to a power source.

The narrow elongate cover 23, when disposed in a horizontal plane, has a rectangular bottom wall 41 and an upwardly extending peripheral wall structure comprising two side walls 43 and 45, and two end walls 47 and 49 which combine to form a generally box-shaped structure defining an elongate narrow interior space 51. The side and end walls 43, 45, 47, 49 are preferably formed as one piece with the bottom wall 41 and project upwardly therefrom, as shown in the drawings. More specifically, the bottom wall 41 is bent at opposite ends to form end walls 47, 49, and at its sides to form the side walls 43, 45, respectively. As more fully discussed below, the cover 23 is releasably attachable to the backing plate 21 in a closed position.

It is to be understood that the backing plate 21 and cover 23 of the light fixture 11 may have shapes other than rectangular. For example, the fixture 11 may have rounded ends as disclosed in co-assigned U.S. Pat. No. Des. 359,374.

In the particular embodiment shown in the drawings, the cover 23 has two lane openings 53 in its bottom wall 41. Two lamp assemblies, one for each opening 53, are releasably attached to the cover 23 adjacent respective openings in its bottom wall 41. Each lamp assembly is generally designated 55. It is to be understood that any number of lamp assemblies 55 may be mounted on the cover 23 as disclosed in the aforesaid co-assigned U.S. design patent application, which discloses light fixtures having one, two, three or four lamp assemblies. Since each lamp assembly 55 is of identical construction, a description of one will suffice for both.

The lamp assembly 55 includes a lamp, such as a halogen lamp 57, a reflector 59 with a curved reflective surface for reflecting light emitted by the lamp in a generally downward direction onto the working surface when the cover 23 is attached to the backing plate 21, and a lamp housing 61 mounted on the bottom wall 41 of the cover in the interior space 51. The lamp 57 could also be an incandescent lamp.

The lamp housing 61 includes an annular body 63 having a top wall 63*a* at the upper end of the housing, a circular side wall 63*b*, an open bottom 65 which is closed by a diffuser 67, and a flange 69 which projects radially outwardly from the side wall 63*b* adjacent the open bottom 65 of the body 63 at the lower end of the housing. The lamp 57 and reflector 59 are housed by the lamp housing 61 within the annular body 63 adjacent its open bottom 65. The diffuser 67 comprises a flat lens which is releasably attached to the lamp housing by three resilient retaining fingers 71 which are adapted to flex radially outwardly with respect to the housing 61 to a position in which the diffuser 67 may be positioned with its periphery against the housing underlying the open bottom 65 of the housing and the reflector 59. After so positioning the diffuser 67 against the lamp housing 61, the retaining fingers 71 spring back to a position in which they hold the diffuser in place.

Figure 3:
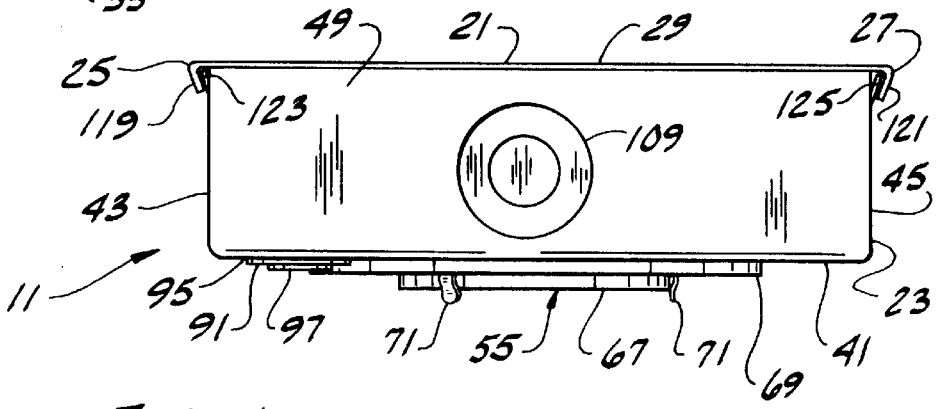
FIG. 3 is a right end view of the fixture of FIG. 1.
Figure 4:
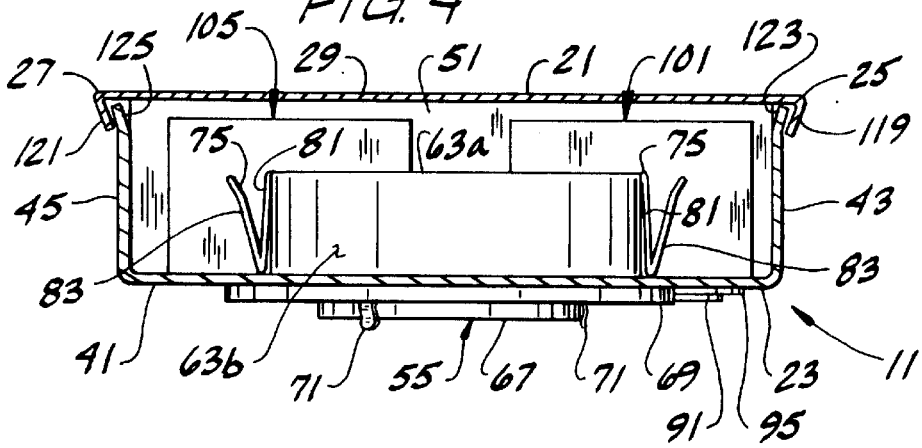
FIG. 4 is a cross section taken along line 4—4 of FIG. 1.

Each opening 53 in the bottom wall 41 of the cover 23 has a diameter sufficient to receive the respective body 63 of the lamp housing 61, but insufficient to permit passage of the flange 69 of the housing therethrough. Thus, as illustrated in FIG. 2, the lamp housing 61 is mounted on the cover 23 by inserting the body 63 of the housing upwardly through its respective opening 53 until the flange 69 of the housing lies flat against the bottom wall 41 of the cover. As shown in FIGS. 3 and 4, the diffuser 67 of the lamp assembly 55, when the lamp assembly is mounted on the cover 23, is generally flush with the bottom wall 41 of the cover. In this position, the halogen lamp 57 and reflector 59 are disposed in the interior space 51 of the cover 23.

Figure 5:
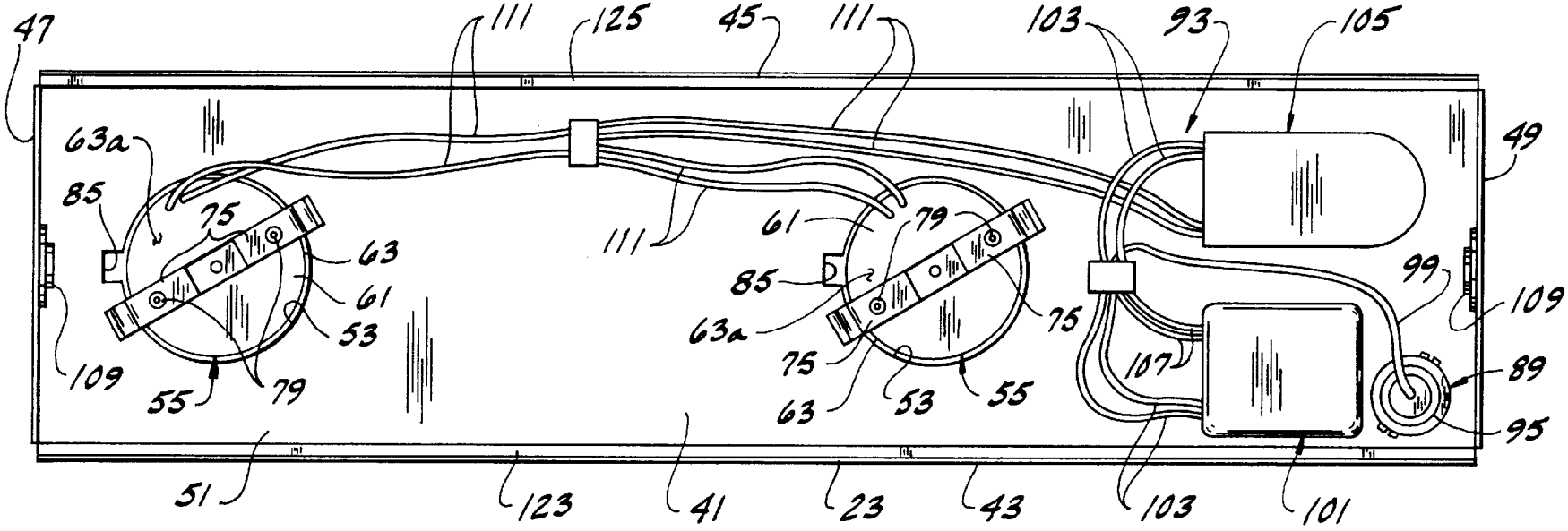
FIG. 5 is a is a top plan of a cover of the light fixture.

Two resilient spring clips, each designated 75, are provided on each lamp housing 61 for engaging the top surface of the bottom wall 41 of the cover to hold the housing in place. Each spring clip 75 is generally V-shaped in construction and is mounted by a rivet 79 on the top wall 63*a* of the body 63 of the lamp housing 61, as shown in FIG. 5. In its normal unflexed position, a first (inner) leg 81 of the clip 75 extends down from the top wall 63*a* of the body 63 generally along the side wall 63*b* of the body to the flange 69. A second (outer) leg 83 of the clip 75, which is integrally joined to the lower end of the first leg 81, extends from the junction of the legs adjacent the flange 69 upwardly and outwardly with respect to the side wall 63*b* of the lamp housing 61. In its flexed position, the second leg 83 of the spring clip 75 may be flexed inwardly to a position in which it is held against the side wall 63*a* of the body 63 of the lamp housing 61. When the lamp assembly 55 is attached to the cover 23, the junction of the legs 81, 83 of the clip 75 engages the top surface of the bottom wall 41 of the cover to retain the lamp assembly in the cover in a position where the flange 69 of the lamp assembly 55 is generally flush with the bottom wall 41.

In order to insert the body 63 of the lamp assembly 55 up through its respective opening 53, a keyway 85, one for each opening, is formed in the cover in communication with the opening for allowing passage of one of the spring clips 75 therethrough when the clip is in its inwardly flexed condition. When inserting the body 63 of the lamp assembly 55 up through the opening, the other spring clip 75 is also inwardly flexed such that its second leg 83 is held against the side wall 63*a* of the body 63 of the lamp housing 61. After inserting the body 63 of the lamp assembly 55 up through its respective opening 53 until the flange 69 engages the bottom wall 41, the lamp assembly 55 is rotated in either direction (i.e., clockwise or counterclockwise) so that the clip 75 which passed through the keyway 85 clears the keyway and both spring clips 75 engage the bottom wall 41 to hold the lamp assembly 55 on the cover 23.

Another smaller opening designated 87 is formed in the bottom wall 41 of the cover 23 and receives a switch, generally designated 89, for operating the light fixture 11. The switch 89, in the shown embodiment, comprises an actuator embodying a touch sensor 91 mounted on the cover 23 and accessible from the exterior of the cover. Circuitry, generally designate 93, in the interior space 51 of the cover 23 electrically connects the touch sensor 91 and the lamp assemblies 55 to a power source (not shown). The touch sensor 91 is mounted on the bottom wall 41 of the cover 23 adjacent the opening 87 for turning the light fixture 11 on and off. An on-off rocker switch may also be suitable for operating the light fixture. As illustrated in FIG. 2, the sensor 91 includes a bushing 95 which is snap-fitted into the opening 87 so that it engages the cover 23, and a touch pad 97 which is held within the bushing 95. The touch pad 97 is electrically isolated from the cover 23 by the bushing 95 which is made from electrically insulative material (e.g., plastic). The touch pad 97 of the sensor 91 is substantially flush with the bottom wall 41 of the cover 23 when attached to the cover. In the present embodiment, the touch pad 97 is electrically connected by a wire 99 to a dimmer control generally designated 101. The dimmer control 101 in turn is electrically connected by wiring 103 to a transformer, generally designated 105. The dimmer control is also electrically connected to a power source (not shown) by wire 107 for providing power to the light fixture. Knockouts 109 are provided on the cover 23 and backing plate 21 for electrically connecting the circuitry 93 of the light fixture 11 to the power source.

As illustrated in FIG. 5, the dimmer control 101 and transformer 105 are mounted on the top surface of the bottom wall 41 of the cover 23 at one end thereof by any suitable means, e.g., adhesive. Foam pads (not shown) may be located between the dimmer control 101 and transformer 105 for dampening vibratory forces. The transformer 105 is electrically connected by wiring 111 to the lamp assemblies 55 for providing power thereto. When the light fixture 11 is off, it may be turned on by touching the touch pad 97 of the sensor 91. In the present embodiment, the dimmer control 101 allows a person to touch the touch pad 97 additional times so that the halogen lamps 57 emit varying levels of light. Upon touching the touch pad 97 of the sensor 91 a predetermined number of times (e.g., four times), the lamps 57 of the light fixture 11 are turned off. It is to be understood that the lamp assemblies 55 may be operated by circuitry differing from the present embodiment. For example, the lamp assemblies 55 may be constructed so that the provision of a transformer is unnecessary. Also, the light fixture 11 of the present invention does not have to embody a dimmer control.

As briefly discussed above, the cover 23 may be releasably attached without the aid of fasteners to the backing plate 21 in a closed position (FIGS. 1, 3 and 4) so that the side walls 43, 45 of the cover 23 extend down from the backing plate 21 and the bottom wall 41 of the cover 23 is spaced below the backing plate 21. It should be observed that the backing plate 21 is capable of being mounted on the downwardly-facing surface 13 without the cover 23 attached to it. When attached to the backing plate 21 in the aforesaid closed position, the cover 23 substantially encloses the lamp assemblies 55 and circuitry 93 (i.e., dimmer control 101, transformer, and their associated wiring) within the interior space of the cover.

Referring to FIGS. 2–4, opposite side edges of respective long sides 25, 27 of the backing plate 21, when disposed in a horizontal plane, have flanges 119 and 121 inclined laterally inwardly and downwardly. These flanges are preformed in the backing plate 21 by a bending operation. The two side walls 43, 45 of the cover 23 have upper edge margins 123, 125 which are bent to extend laterally outwardly and upwardly for fitting inside and above the backing plate flanges 119, 121 when the cover 23 is attached to the backing plate 21 (see FIG. 4). In order to position the upper edge margins 123, 125 of the cover 23 between the backing plate flanges 119, 121 to attach the cover 23 to the plate 21, the side walls 43, 45 of the cover 23 may be resiliently squeezed laterally inwardly toward one another and then released to allow the upper edge margins 123, 125 to spring into engagement with the flanges 119, 121 to releasably attach the cover 23 to the backing plate 21 with the backing plate in the aforesaid closed position. The side walls 43, 45 are detached from the end walls 47, 49 at their adjacent edges for enabling the inward movement of the side walls. Similarly, to remove the cover 23 from the backing plate 21, the side walls 43, 45 of the cover 23 are squeezed laterally inwardly toward one another so that the upper margins 123, 125 of the side walls 43, 45 disengage the flanges 119, 121 of the backing plate 21 whereupon the cover 23 may be moved downwardly and away from the backing plate 21. Thus, the cover 23 may be releasably attached to the backing plate 21 by hand and without the aid of tools. Furthermore, no fasteners are required.

When the cover 23 is mounted on the backing plate 21 in its closed position, the housing 61 of the lamp assembly 55 is spaced from the backing plate 21 to minimize the transfer of heat from the lamp housing to the backing plate. As shown in FIG. 4, the top wall 63*b* of the lamp housing 61 is spaced from the backing plate 21 a fairly significant distance considering the overall height of the light fixture 11. In the present embodiment, the overall height of the light fixture 11 is less than one and one-half inches. Thus, it will be observed that the light fixture 11, when mounted on the downwardly-facing surface 13 of the cabinet 17, would be unobtrusive and substantially hidden from the view of a person standing in front of the cabinet.

It should also be noted that the light fixture 11 of the present invention may be easily assembled. The dimmer control 101 and transformer 105 are mounted on the top surface of the bottom wall 41 of the cover 23 by an adhesive, for example. Each lamp assembly 55, due to its modular nature, may be attached to the cover 23 by aligning one of the spring clips 75 with the keyway 85 of its respective opening 53 and inserting the body 63 of the lamp housing 61 into the opening while flexing both clips. After passing the lamp housing 61 up through the opening 53 until the flange 69 engages the bottom wall 41 of the cover 23, the lamp assembly 55 is rotated so that both spring clips 75 engage the bottom wall 41. The sensor 91 is easily attached to the cover 23 by snap-fitting the bushing 95 of the sensor 91 into the opening 87 provided in the cover 23. The necessary circuitry 93 may then be connected.

To install the light fixture 11, the backing plate 21 is mounted on a surface, such as the downwardly-facing surface 13 of the cabinet 17, with screw fasteners 33 in a position where the upper surface 29 of the plate 21 is adjacent the downwardly-facing surface 13. The next step is to electrically connect the light fixture 11 with a power source (not shown), including grounding the ground wire 37 provided on the backing plate 21. The electrical connection process may require removal of the knockout 109 of the backing plate 21 before it is mounted on surface 13 and/or removal of one of the knockouts of the cover 23. After the electrical connections are made, the cover 23 may be attached to the backing plate 21 by squeezing the side walls 43, 45 of the cover 23 laterally inwardly toward one another while inserting them between the flanges 119, 121 of the backing plate 21, and then releasing the walls 43, 45 to allow the upper edge margins 123, 125 to spring into engagement with the flanges 119, 121. The cover 23 may just as easily be removed from the backing plate 21 to perform routine maintenance, such as replacing the dimmer control or transformer for example, by squeezing the side walls 43, 45 of the cover 23 laterally inwardly toward one another so that the upper margins 123, 125 of the side walls 43, 45 disengage the flanges 119, 121 of the backing plate 21. The cover 23 may then be moved downwardly and away from the backing plate 21.

In view of the above, it will be seen that the several objects of the invention are achieved and other advantageous results attained.

As various changes could be made in the above constructions without departing from the scope of the invention, it is intended that all matter contained in the above description as shown in the accompanying drawing shall be interpreted as illustrative and not in a limiting sense.

What is claimed is:

1. An under-cabinet light fixture adapted to be mounted on a downwardly-facing surface for illuminating another surface therebelow, said light fixture comprising:

a backing plate, means for mounting the backing plate flat on said downwardly-facing surface, a cover for the backing plate, said cover having a plurality of side walls interconnected by a bottom wall and being releasably attached to the backing plate in a closed position in which the backing plate and cover combine to form a substantially enclosed interior space, at least one lamp opening in the bottom wall of the cover, at least one lamp assembly mounted adjacent the lamp opening in the bottom wall of the cover, said lamp assembly comprising a lamp housing mounted in said interior space, the housing of the lamp assembly having an open bottom generally in registry with the opening in the bottom wall of the cover, said housing being spaced from the backing plate to minimize the transfer of heat from the lamp assembly to the backing plate, said lamp assembly further comprising a halogen lamp for emitting light in a generally downward direction onto said another surface when the cover is attached to the backing plate in said closed position, and a diffuser closing said open bottom of the housing, an actuator mounted on the fixture and accessible from outside the cover for energizing said halogen lamp, and a dimmer control in said enclosed interior space electrically connected to said actuator for varying the intensity of light emitted by said halogen lamp, said actuator on the fixture being operable and turning the halogen lamp on and off and also varying the intensity of the light emitted by the halogen lamp, said backing plate being adapted to be mounted on said downwardly-facing surface without the cover in said closed position, the cover thereafter being releasably attached to the backing plate in said closed position, said backing plate and cover having sufficiently thin profiles that when the backing plate and cover are mounted on said downwardly-facing surface with the cover in said closed position, the overall height of the fixture is less than about 1½ inches.

2. An under-cabinet light fixture adapted to be mounted on a downwardly-facing surface for illuminating another surface therebelow, said light fixture comprising:

a backing plate, means for mounting the backing plate flat on said downwardly-facing surface, a cover for the backing plate, said cover having a plurality of side walls interconnected by a bottom wall and being releasably attached to the backing plate in a closed position in which the backing plate and cover combine to form a substantially enclosed interior space, at least one lamp opening in the bottom wall of the cover, at least one lamp assembly mounted adjacent the lamp opening in the bottom wall of the cover, said lamp assembly comprising a lamp housing mounted in said interior space, the housing of the lamp assembly having an open bottom generally in registry with the lamp opening in the bottom wall of the cover, said housing further being spaced from the backing plate to minimize the transfer of heat from the lamp assembly to the backing plate, said lamp assembly further comprising a halogen lamp for emitting light in a generally downward direction onto said another surface when the cover is attached to the backing plate in said closed position, and a diffuser closing said open bottom of the housing, an actuator on the fixture accessible from outside the cover for energizing said halogen lamp, and a dimmer control in said enclosed interior space electrically connected to said actuator for varying the intensity of light emitted by said halogen lamp, said backing plate being adapted to be mounted on said downwardly-facing surface without the cover in said closed position, the cover thereafter being releasably attached to the backing plate in said closed position, said backing plate and cover having sufficiently thin profiles that when the backing plate and cover are mounted on said downwardly-facing surface with the cover in said closed position, the overall height of the fixture is less than about 1½ inches, said actuator comprising a touch sensor having a touch pad substantially flush with the bottom wall of the cover, said dimmer control being electrically connected to the touch sensor.

3. An under-cabinet halogen light fixture adapted to be mounted on a downwardly-facing surface for illuminating another surface therebelow, said light fixture comprising:

a backing plate, means for mounting the backing plate flat on said downwardly-facing surface, a cover for the backing plate, said cover having a plurality of side walls interconnected by a bottom wall and being releasably attached to the backing plate in a closed position in which the backing plate and cover combine to form an enclosure substantially enclosing an interior space, at least one lamp opening in the bottom wall of the cover, at least one lamp assembly mounted on the bottom wall of the cover adjacent the lamp opening in the bottom wall of the cover, said lamp assembly comprising a lamp housing having an upper end and a lower end and having a flange at its lower end, said housing being mounted on said bottom wall of the cover with said flange engaging said bottom wall around said lamp opening, said lamp assembly further comprising a lamp socket, a halogen lamp in the socket for emitting light, a reflector for reflecting light from the lamp in a generally downward direction onto said another surface when the cover is attached to the backing plate in said closed position, and a substantially flat diffuser attached to the lamp housing immediately adjacent the bottom wall of the cover below the halogen lamp and lamp socket whereby light emitted by the halogen lamp passes through the diffuser onto said another surface, said lamp housing being of such height from said flange at said lower end thereof to said upper end thereof that said upper end is spaced from the backing plate to minimize the transfer of heat from the lamp assembly to the backing plate, a transformer in said enclosed interior space attached to the bottom wall of the cover, wiring in said interior space connecting said transformer and said lamp socket, an actuator on the enclosure accessible from outside the fixture for energizing said halogen lamp, said backing plate being adapted to be mounted on said downwardly-facing surface without the cover in said closed position, the cover thereafter being releasably attached to the backing plate in said closed position.

4. An under-cabinet light fixture adapted to be mounted on a downwardly facing bottom surface of a cabinet for illuminating space therebelow comprising:

a generally flat backing plate for installation flat on said downwardly facing bottom surface, said backing plate being of generally elongate rectangular shape having longitudinal and end edges;

a cover for the backing plate having a bottom wall shaped generally to match the backing plate and an upwardly extending peripheral wall structure having an upper edge and being attached to the backing plate after installation of the backing plate in place on said downwardly facing surface with the upper edge of said peripheral wall structure engaging the backing plate and with the cover in a closed position in which the assembly of the plate and cover form an enclosure substantially enclosing an interior space;

said upwardly extending peripheral wall structure of the cover having a height substantially less than the width of the backing plate and cover so that the fixture has a relatively thin profile;

said cover having at least one circular lamp opening in the bottom wall thereof;

at least one lamp assembly mounted on the bottom wall of the cover, said lamp assembly comprising a lamp housing, a halogen lamp and a reflector, said lamp housing comprising an annular body having a generally flat top wall, a circular side wall extending down from the top wall, said halogen lamp and said reflector being housed by the lamp housing within the annular body, the reflector reflecting light emitted by the halogen lamp in generally downward direction toward said space;

said circular side wall of said annular body having a diameter generally corresponding to that of the lamp opening in the bottom wall of the cover, said annular body being secured at a lower end of said circular wall to said bottom wall of the cover with said lower end in surrounding relation with said lamp opening;

said annular body having a flange extending radially outwardly at the lower end of said circular wall thereof, said flange engaging said bottom wall of the cover around said lamp opening and being secured to said bottom wall;

said circular side wall of the lamp housing having a height substantially less than the height of the upwardly extending peripheral wall structure of the cover so that the flat top wall of the annular body of the lamp housing is spaced from backing plate when the cover is in said closed position to minimize the transfer of heat from the lamp assembly to the backing plate; and a thin substantially flat diffuser for diffusing light emitted downward by said halogen lamp, said diffuser being mounted closely adjacent the bottom wall of the cover so as to contribute to the thin profile of the fixture.

5. A light fixture as set forth in claim 4 wherein said flange is engaged with an exterior of said bottom wall outside said interior space, and wherein said annular body extends up through said lamp opening.

6. A light fixture adapted to be mounted on a downwardly-facing surface for illuminating another surface therebelow, said light fixture comprising:

a backing plate for installation flat on said downwardly-facing surface, a cover releasably attached to the backing plate in a closed position in which the backing plate and cover combine to form a substantially enclosed interior space, at least one lamp opening in the cover, at least one lamp assembly mounted adjacent the lamp opening in the cover, said lamp assembly comprising a lamp housing mounted in said interior space, the housing of the lamp assembly having an open bottom generally in registry with the lamp opening in the cover, said housing being spaced from the backing plate to minimize the transfer of heat from the lamp assembly to the backing plate, said lamp assembly further comprising a halogen lamp for emitting light in a generally downward direction onto said another surface when the cover is attached to the backing plate in said closed position, and a diffuser closing said open bottom of the housing, an actuator mounted on the fixture and accessible from outside the cover for energizing said halogen lamp, and a dimmer control in said interior space electrically connected to said actuator for varying the intensity of light emitted by said halogen lamp, said actuator on the fixture turning the halogen lamp on and off and also varying the intensity of the light emitted by the halogen lamp, said backing plate and cover having sufficiently thin profiles that when the backing plate and cover are mounted on said downwardly-facing surface with the cover in said closed position, the overall height of the fixture is less than about 1½ inches.

7. A light fixture adapted to be mounted on a downwardly-facing surface for illuminating another surface therebelow, said light fixture comprising:

a backing plate for installation flat on said downwardly-facing surface, a cover releasably attached to the backing plate in a closed position in which the backing plate and cover combine to form a substantially enclosed interior space, at least one lamp opening in the cover, at least one lamp assembly mounted adjacent the lamp opening in the cover, said lamp assembly comprising a lamp housing mounted in said interior space, the housing of the lamp assembly having an open bottom generally in registry with the lamp opening in the cover, said lamp assembly further comprising a halogen lamp for emitting light in a generally downward direction onto said another surface when the cover is attached to the backing plate in said closed position, and a diffuser closing said open bottom of the housing, an actuator mounted on the fixture and accessible from outside the cover for energizing said halogen lamp, and a dimmer control in said interior space electrically connected to said actuator for varying the intensity of light emitted by said halogen lamp, said actuator on the fixture turning the halogen lamp on and off and also varying the intensity of the light emitted by the halogen lamp, said backing plate and cover having sufficiently thin profiles that when the backing plate and cover are mounted on said downwardly-facing surface with the cover in said closed position, the overall height of the fixture is less than about 1½ inches.

* * * * *

UNITED STATES PATENT AND TRADEMARK OFFICE

CERTIFICATE OF CORRECTION

PATENT NO. : 5,769,529

DATED : June 23, 1998

INVENTOR(S) : Stephen P. Weinstock

It is certified that error appears in the above-identified patent and that said Letters Patent is hereby corrected as shown below:

Column 4, line 11, "two lane openings" should read ---two lamp openings---.

Signed and Sealed this

Eighth Day of December, 1998

Bruce Lehman

*Attest:*

BRUCE LEHMAN

*Attesting Officer*

*Commissioner of Patents and Trademarks*